United States Patent [19]

Rohringer

[11] 4,219,605

[45] Aug. 26, 1980

[54] PROCESS FOR FLAMEPROOFING SYNTHETIC FIBRE MATERIAL AND PRODUCT

[75] Inventor: Peter Rohringer, Schönenbuch, Switzerland

[73] Assignee: CIBA-GEIGY Corporation, Ardsley, N.Y.

[21] Appl. No.: 834,344

[22] Filed: Sep. 19, 1977

[30] Foreign Application Priority Data

Sep. 29, 1976 [CH] Switzerland ..... 12300/76

[51] Int. Cl.[2] ..... D02G 3/02; B05D 3/02

[52] U.S. Cl. ..... 428/361; 252/8.1; 260/45.75 K; 260/45.75 J; 260/45.75 S; 427/393.3; 427/427; 427/428; 428/289; 428/394; 428/921

[58] Field of Search ..... 427/390 D, 394, 427, 427/428; 428/920, 921, 289, 361, 394, 921; 106/15 FP, 18.25; 252/8.1; 8/115.6; 260/45.75 K, 45.75 J, 45.75 S, DIG. 24

[56] References Cited

U.S. PATENT DOCUMENTS

| | | | |
|---|---|---|---|
| 2,413,163 | 12/1946 | Bacon | 427/390 D X |
| 3,108,010 | 10/1963 | Nakane et al. . | |
| 3,432,461 | 3/1969 | Hill et al. | 260/45.75 K |
| 3,642,628 | 2/1972 | Palethorpe | 260/45.75 K |
| 3,877,974 | 4/1975 | Mischutin | 427/390 D X |
| 3,979,545 | 9/1976 | Braus et al. | 106/15 FP X |
| 4,022,750 | 5/1977 | Takeya et al. | 260/45.75 K |
| 4,046,701 | 9/1977 | Smith | 252/8.1 |

FOREIGN PATENT DOCUMENTS 2254620 12/1976 France .

*Primary Examiner*—Michael F. Esposito
*Assistant Examiner*—Thurman K. Page
*Attorney, Agent, or Firm*—Prabodh I. Almula

[57] ABSTRACT

The invention relates to a process for flameproofing organic synthetic fibre material, wherein (a) a flameproofing agent which contains at least one bromine-containing, aromatic, aliphatic or cycloaliphatic compound and (b) a stabilizer which contains at least one organo-tin compound of tetravalent tin are applied to the fibre material and the fibre material treated in this way is subjected to a heat treatment.

The process according to the invention can be carried out as a single-stage or two-stage process and yields flame-resistant fiber finishes stabilized to light and heat.

12 Claims, No Drawings

PROCESS FOR FLAMEPROOFING SYNTHETIC FIBRE MATERIAL AND PRODUCT

The invention relates to a process for flameproofing organic synthetic fibre material, wherein (a) a flameproofing agent which contains at least one bromine-containing, aromatic, aliphatic or cycloaliphatic compound and (b) a stabiliser which contains at least one organo-tin compound of tetravalent tin are applied to the fibre material and the fibre material treated in this way is subjected to a heat treatment.

The process according to the invention can be carried out as a single-stage or two-stage process.

In the two-stage process, the flameproofing agent is first applied to the fibre material, and the material is subjected to a heat treatment, in the first stage, and, in the second stage, the stabiliser is applied to the fibre material and the material is again subjected to a heat treatment.

In the single-stage process, which is preferred to the two-stage process, the flameproofing agent is applied together with the stabiliser to the fibre material and the material treated in this way is then subjected to a heat treatment.

Compounds which can be used as the bromine-containing compound which is contained in the flameproofing agent employed according to the invention are aromatic, in particular aliphatic and especially cycloaliphatic compounds. In addition to bromine atoms, the bromine-containing compound can contain further halogen atoms, especially chlorine atoms. This applies in particular to cycloaliphatic compounds. However, bromine compounds which do not contain any further halogen atoms are preferred.

The bromine-containing compounds as a rule contain dibromoalkyl radicals having 2 to 9, and preferably 3 to 7, carbon atoms, especially dibromopropyl radicals. The aromatic and cycloaliphatic compounds can also contain bromine atoms which are bonded direct to the aromatic or cycloaliphatic ring. This type of bromine atom linkage is preferred, in particular, in the case of cycloaliphatic compounds.

The bromine-containing compounds can be either in the solid or in the liquid state. Solid compounds which are in the solid aggregate state at 20° C. under atmospheric pressure are, however, preferred. Compounds which have a melting point between 70° and 200° C., and especially between 100° and 180° C., are particularly suitable.

Preferred, solid aromatic bromine compounds contain 1 to 2 phenyl radicals which are unsubstituted or substituted by bromoalkyl or, preferably, bromine and also are etherified or esterified by bromoalkyl. Aromatic bromine compounds of this type contain a total of 4 to 12, and preferably 4 to 8, bromine atoms.

Preferred, solid aliphatic bromine compounds have branched or, in particular, straight chains. These compounds are free or etherified esters, amides or ethers or are pure alkanes. Aliphatic bromine compounds of this type contain 3 to 15, and preferably 6 to 11, carbon atoms and 2 to 12, and preferably 4 to 6, bromine atoms.

Preferred, solid cycloaliphatic bromine compounds consist, inter alia, of terpenes which are esterified by bromoalkyl and in which the terpene ring is substituted by 2 to 8 halogen atoms, in particular chlorine atoms and especially bromine atoms, or, as the most preferred bromine-containing compounds, of dicycloalkylalkanes having 11 to 22, and preferably 12 to 18, carbon atoms and 4 to 18, and preferably 4 to 8, bromine atoms, or, especially, of brominated cycloalkanes having 7 to 12 ring carbon atoms and 4 to 6 bromine atoms bonded to these ring carbon atoms.

Specific examples of bromine-containing, solid aromatic compounds which may be mentioned are 1,3,4,6-tetrakis-bromomethyl-2,5-dimethyl-benzene, in particular 2,6,2',6'-tetrabromo-bisphenol A bis-2,3-dibromopropyl ether and especially bis-2,3-dibromopropyl terephthalate, examples of aliphatic compounds which may be mentioned are 2,3-dibromopropionamide, methylene-bis-2,3-dibromo-propionamide and in particular 1,2,4,5,9,10-hexabromodecane and di-2,3-dibromopropionamidomethylene ether, and examples of the most preferred cycloaliphatic compounds which may be mentioned are 2,3-dibromopropyl cyclohexen-4,5-yl-3,6-endodichloromethylene-3,4,5,6-tetrachloro-1,2-dicarboxylate, in particular 2,3-dibromopropyl cyclohexyl-3,6-endomethylene-4,5-dibromo-1,2-dicarboxylate, specifically 1,2-bis-(3,4-dibromocyclohexyl)-1,2-dibromoethane and 1,2,3,4- or 1,2,5,6-tetrabromocyclooctane and especially 1,2,5,6,9,10-hexabromocyclododecane (abbreviated as HBCD).

It is also possible to use mixtures of bromine-containing compounds, for example of methylene-bis-2,3-dibromopropionamide and 2,3'-dibromo-propionamide or of 1,2-bis-(3,4-dibromocyclohexyl)-1,2-dibromoethane and HBCD. It has proved particularly advantageous to employ a single bromine compound, i.e. HBCD, as the flameproofing agent.

The bromine-containing compounds which are contained in the flameproofing agent employed according to the invention are known per se or are prepared according to known methods, for example by bromination or etherification of acid esters or the methylolamide derivatives thereof and especially by the addition of bromine to compounds having olefinic double bonds, especially to cycloalkenes.

For example, HBCD is obtained by reacting bromine with cyclododecane-1,5,9-triene.

Preferred organo-tin compounds, which are contained in the stabiliser employed according to the invention, are polymeric or, preferably, monomeric compounds which are of the formula

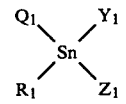

(1)

in which $R_1$ is an aliphatic, cycloaliphatic or aromatic hydrocarbon radical, $Y_1$ is an aliphatic hydrocarbon radical bonded via an —O— or —OOC— bridge, or is of the formula —S—$X_1$, in which $X_1$ is an aliphatic or aromatic hydrocarbon radical, and $Z_1$ and $Q_1$ in each case have the meanings defined for $R_1$ or $Y_1$, or $Y_1$ and $Z_1$ together are =S or =O or are a divalent organic radical which, together with the Sn atom, forms a heterocyclic ring, the ring having an —S—, —O— or —OOC— bridge in the position adjacent to the Sn atom, or, if the organo-tin compound is in the polymeric form, $Q_1$ is also hydroxyl and $Y_1$ and $Z_1$ together are an —S— or —O— bridge which is bonded to different Sn atoms, or, if $Y_1$ and $Z_1$ together are =S, $Q_1$ is also —SH.

Further preferred organo-tin compounds are of the formula

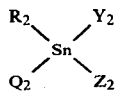

(2)

in which $R_2$ is alkyl having 1 to 18 carbon atoms or alkenyl having 2 to 18 carbon atoms, which are unsubstituted or substituted by a keto group or by an alkylcarboxylic acid alkyl ester group having 2 to 18 carbon atoms, or are phenyl, naphthyl or cycloalkyl or cycloalkenyl having 5 or 6 ring members, or benzyl, $Y_2$ is alkoxy having 1 to 18 carbon atoms, a carboxyl radical of a monocarboxylic acid having 1 to 18 carbon atoms or a carboxyl radical of a dicarboxylic acid monoalkyl ester having 2 to 8 carbon atoms in the acid part and 1 to 18 carbon atoms in the alcohol part, or the radical of a mercaptomonocarboxylic acid alkyl ester or mercaptodicarboxylic acid alkyl ester or monocarboxylic acid mercaptoalkyl ester, each having 2 to 8 carbon atoms in the alcohol part, or is of the formula —S—$X_2$, in which $X_2$ is alkyl having 1 to 18 carbon atoms which is unsubstituted or substituted by hydroxyl or alkoxy having 1 to 18 carbon atoms, or is phenyl, naphthyl or benzyl which are unsubstituted or substituted by halogen or alkyl having 1 to 4 carbon atoms, and $Z_2$ and $Q_2$ in each case have the meanings defined for $R_2$ or $Y_2$, or $Y_2$ and $Z_2$ together, as a divalent organic radical, with the Sn atom form a ring in which the divalent radical is derived from a dicarboxylic acid, a mercaptomonocarboxylic acid, a hydroxymonocarboxylic acid, a glycol di-mercaptocarboxylic acid ester, a dicarboxylic acid dimercaptoalkyl ester, a hydroxymonothiocarboxylic acid, a glycol or a monothioglycol or dithioglycol, each having 2 to 18 carbon atoms, and is bonded to the Sn atom via the two indicated free functional groups, or $Y_2$ and $Z_2$ together, in the case of monomeric organo-tin compounds, are also =S or =O, or, in the case of polymeric organo-tin compounds, are also —S— or —O— bridges, which are bonded to different Sn atoms, and, if the organo-tin compound is in a polymeric form dehydrated to different degrees, $Q_2$ is also hydroxyl, or, if $Y_2$ and $Z_2$ together are =S, $Z_2$ is also —SH.

If $Y_2$, or $Y_2$ and $Z_2$ together, in formula (2) are as defined in the Table which follows, the corresponding organo-tin compounds contain a group of, for example, one of the formulae (2.1) to (2.15) indicated below, in which A is alkyl, alkylene, alkenyl, alkenylene, aryl or arylene.

| Symbol in formula (2) | Definition of the symbol in formula (2) | Formula of the group contained in the corresponding organo-tin compound | Designation of the formula |
|---|---|---|---|
| $Y_2$ | Carboxyl radical of a monocarboxylic acid | 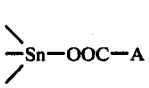 | (2.1) |
| | Carboxyl radical of a dicarboxylic acid monoalkyl ester | 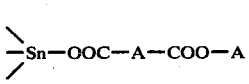 | (2.2) |
| | Radical of a mercaptomonocarboxylic acid alkyl ester | 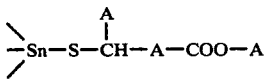 | (2.3) |
| | Radical of a mercaptodicarboxylic acid alkyl ester | 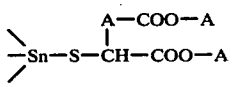 | (2.4) |
| | | 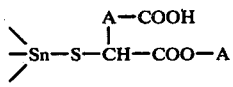 | (2.5) |
| | | 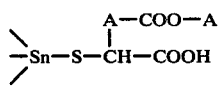 | (2.6) |
| | Radical of a monocarboxylic acid mercaptoalkyl ester | 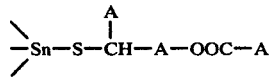 | (2.7) |
| $Y_2$ and $Z_2$ together | Radical derived from a dicarboxylic acid | 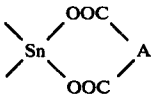 | (2.8) |
| | Radical derived from a mercaptomonocarboxylic acid | 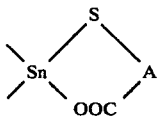 | (2.9) |

-continued

| Symbol in formula (2) | Definition of the symbol in formula (2) | Formula of the group contained in the corresponding organo-tin compound | Designation of the formula |
|---|---|---|---|
| | Radical derived from a hydroxymonocarboxylic acid | 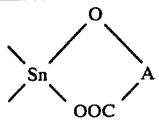 | (2.10) |
| | Radical derived from a glycol di-mercaptocarboxylic acid ester | 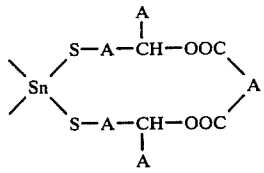 | (2.11) |
| | Radical derived from a dicarboxylic acid dimercapto alkyl ester | 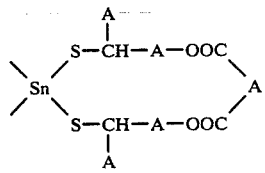 | (2.12) |
| $Y_2$ and $Z_2$ together | Radical derived from a glycol | 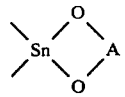 | (2.13) |
| | Radical derived from a monothio glycol | 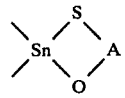 | (2.14) |
| | Radical derived from a dithio glycol | 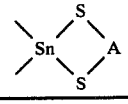 | (2.15) |

Monomeric organo-tin compounds which are of the formula

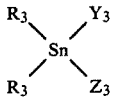

(3)

in which $R_3$ is alkyl having 1 to 18 carbon atoms, $Y_3$ and $Z_3$ in each case are a carboxyl radical of a dicarboxylic acid monoalkyl ester or the radical of a mercaptomonocarboxylic acid alkyl ester, each having 2 to 8 carbon atoms in the acid part and 1 to 18 carbon atoms in the alcohol part, or $Y_3$ and $Z_3$ together with the Sn atom form a ring and are the radical of a dicarboxylic acid or of a mercaptomonocarboxylic acid, each having 2 to 18 carbon atoms, and especially organo-tin compounds which are of the formula

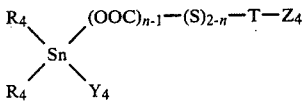

(4)

in which n is 1 or 2, $R_4$ is alkyl having 4 to 12 carbon atoms, T is methylene, ethylene or vinylidene, $Y_4$ is $-(OOC)_{n-1}-(S)_{2-n}-T-COOR_4$ and $Z_4$ is $-COOR_4$, or $Y_4$ and $Z_4$ together are —OOC—, are of primary interest.

Depending on the value of n in formula (4), the organo-tin compounds which are of primary interest are of any one of the formulae

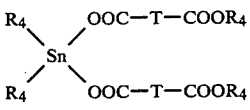

(n = 2), (5)

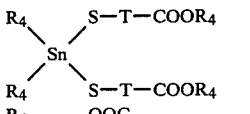

(n = 1), (6)

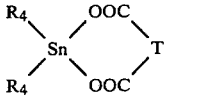

(n = 2), (7)

or

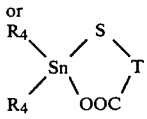

(n = 1), (8)

in which $R_4$ and T are as defined.

The following organo-tin compounds of the formulae (9) to (20), preferably (21) to (41) and especially (42) to (50) may be mentioned as examples of specific representatives of organo-tin compounds of the formula (1) to (8):

$CH_3-O[-Sn(C_4H_9)_2-O]_n-CH_3$ n = 1 4 to 6,4 (9)

$C_3H_7-O[-Sn(C_5H_{11})_2-O]_n-C_3H_7$ n = 7.5 (10)

-continued

| | | |
|---|---|---|
| $C_4H_9-O[-Sn(C_4H_9)_2-O]_n-C_4H_9$ | n = 10.66 | (11) |
| $C_4H_9-CH(C_2H_5)-CH_2-O[-Sn(C_4H_9)_2-O]_n-CH_2-CH(C_2H_5)-C_4H_9$ | n = 2 42 | (12) |
| $CH_3-O[-Sn(C_6H_5)_2-O]_n-CH_3$ | n = 1.52 | (13) |
| $C_4H_9-O-(CH_2)_2-O[-Sn(C_4H_9)_2-O]_n-(CH_2)_2-O-C_4H_9$ | n = 11.29 | (14) |
| $C_6H_5-CH_2-O[-Sn(C_4H_9)_2-O]_n-CH_2-C_6H_5$ | n = 6.83 | (15) |
| $CH_2=CH-CH_2-O[-Sn(C_4H_9)_2-O]_n-CH_2-CH=CH_2$ | n = 6.83 | (16) |
| $(c-C_6H_{11})-O[-Sn(C_4H_9)_2-O]_n-(c-C_6H_{11})$ | n = 8.74 | (17) |
| $CH_3-COO[-Sn(C_4H_9)_2-O]_n-OC-CH_3$ | n = 2; 3; 7 | (18) |
| $C_4H_9-CH(C_2H_5)-COO[-Sn(C_4H_9)_2]_4-OC-CH(C_2H_5)-C_4H_9$ | | (19) |
| $HO[-Sn(CH_2-C_6H_5)_2-O]_3-OC-CH_3$ | | (20) |
| $(C_4H_9)_2SnO$ | | (21) |
| $(C_{12}H_{25})_2SnO$ | | (22) |
| $(C_4H_9)_2Sn(OCH_3)_2$ | | (23) |
| $(C_4H_9)_3SnOCH_3$ | | (24) |
| $(C_4H_9)_3SnOOCCH_3$ | | (25) |
| $(C_4H_9)_2Sn(SC_{12}H_{25})_2$ | | (26) |
| $(C_4H_9)_3SnSC_{12}H_{25}$ | | (27) |

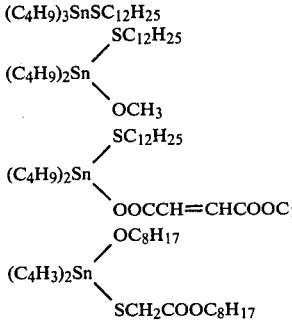

(28)

(29)

(30)

| | |
|---|---|
| $(C_6H_5)_2SnO$ | (31) |
| $(C_6H_5)_2Sn(OCH_3)_2$ | (32) |
| $(C_6H_9)_2Sn[SCH(CH_2COOC_4H_9)COOC_4H_9]_2$ | (33) |

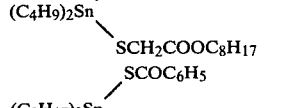

(34)

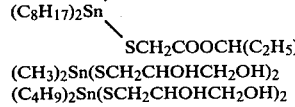

(35)

| | |
|---|---|
| $(CH_3)_2Sn(SCH_2CHOHCH_2OH)_2$ | (36) |
| $(C_4H_9)_2Sn(SCH_2CHOHCH_2OH)_2$ | (37) |

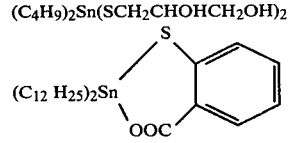

(38)

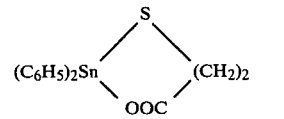

(39)

| | |
|---|---|
| $(C_4H_9)_2Sn(SCH_2COOC_8H_{17})_2$ | (40) |

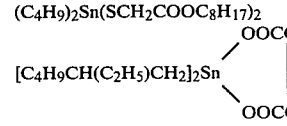

(41)

| | |
|---|---|
| $(C_4H_9)_2Sn[OOCCH=CHCOOCH_2CH(CH_3)_2]_2$ | (42) |
| $(C_4H_9)_2Sn[SCH_2COOCH_2CH(C_2H_5)C_4H_9]_2$ | (43) |

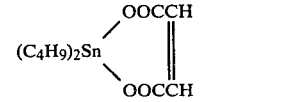

(44)

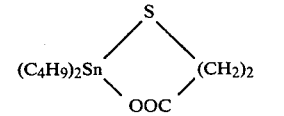

(45)

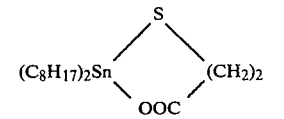

(46)

-continued

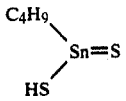

(47)

$C_8H_{17}Sn[SCH_2COOCH(C_2H_5)C_4H_9]_3$ (48)

$(C_8H_{17})_2Sn[SCH_2COOCH(C_2H_5)C_4H_9]_2$ (49)

$(C_4H_9)_2Sn{=}S$ (50)

Alkyl radicals in the formulae (9) to (50) are linear and non-branched unless otherwise indicated.

The organo-tin compounds which are employed in the process according to the invention and are contained in the stabiliser are known per se. Thus, for example, German Pat. No. 838,212 discloses polymeric organo-tin compounds and German Auslegeschriften Nos. 1,020,331, 1,270,799, 1,271,389 and 1,277,853 disclose monomeric organo-tin compounds.

As a rule, the flameproofing agent employed in the process according to the invention contains not only one or more bromine compounds but, in addition to the bromine-containing compound, at least one dispersing agent or emulsifier, water and, if desired, at least one protective colloid or at least one solvent.

Flameproofing agents which, in addition to a bromine-containing compound in the solid state, contain a dispersing agent, water and, if desired, a protective colloid are of primary interest. The dispersing agents and emulsifiers which can be used are the conventional dispersing agents and emulsifiers, for example those customary in the dye and textile industries. Examples which may be mentioned are: lignin-sulphonates, aromatic sulphonic acids, saturated aliphatic dicarboxylic acids substituted by relatively long chain alkyl radicals, sulphonated condensation products of polynuclear, halogenated aromatic compounds, condensation products of aromatic sulphonic acids and formaldehyde, alkylphenol/ethylene oxide adducts, fatty acid/ethylene oxide adducts, fatty amine/ethylene oxide adducts or fatty alcohol/ethylene oxide adducts, sulphonated substituted benzimidazoles and sulphonated fatty acid amides. Good results are achieved, in particular, with lignin-sulphonates, with ethylene oxide adducts of alkylphenols, fatty amines, fatty alcohols or fatty acids, with sulphonated condensation products of polynuclear halogenated aromatic compounds and especially with substituted benzimidazoles or with condensation products of aromatic sulphonic acids and formaldehyde.

Dispersing agents or emulsifiers which, at elevated temperatures, for example at 175° C. to 220° C., do not lead to any yellowing of the treated substrate or at most lead only to yellowing which can be removed on subsequent washing, are preferably employed. In other words, at elevated temperature the dispersing agents should either not decompose or merely form soluble or volatile decomposition products. The amount of dispersing agents or emulsifiers which are employed if desired is preferably between 1 and 100, and preferentially between 1 and 60, percent by weight, relative to the bromine-containing compound. Particularly good results are achieved with 1 to 50, in particular 1 to 20 and especially 1 to 4 percent by weight of dispersing agents, relative to the bromine-containing compound.

With water, the dispersing agents and emulsifiers listed above form emulsions with liquid bromine compounds. However, the bromine-containing compounds are preferably in the form of solid compounds and form suspensions or dispersions with the dispersing agents employed and water.

In order to increase the storage stability, these aqueous suspensions or dispersions can also contain a protective colloid as component (c). Suitable protective colloids are those customarily used industrially, for example polyvinyl alcohol, polyvinylpyrrolidone, methylcellulose, carboxymethylcellulose, hydroxyethylcellulose or hydroxypropylcellulose, gelatine, acid casein, starch paste or polymers of monomers of the acrylic acid series, such as polyacrylic acid, ethyl acrylate copolymers or methyl methacrylate copolymers. Good results are achieved, in particular, with polyvinyl alcohol or hydroxyethylcellulose and especially with carboxymethylcellulose. If a protective colloid is employed, the amount employed is 0.9 to 2.0 percent by weight, relative to the bromine-containing compound.

The flameproofing agents employed in the process according to the invention as a rule contain 50 to 700 g/kg, preferably 200 to 700 g/kg and especially 200 to 500 g/kg of the brominated compound; 0 to 700 g/kg, preferably 0 to 300 g/kg, especially 0.2 to 200 g/kg and in particular 5 to 40 g/kg of a dispersing agent; and 0 to 30 g/kg, and preferably 0.7 to 10 g/kg, of a protective colloid. The mixture is made up to 1 kg with water in each case.

The bromine-containing compound, which preferably is in the solid state, is appropriately ground, as an aqueous dispersion in the presence of a dispersing agent, so that the particles have an average diameter of 1 to 30μ, and preferably 1 to 20μ. Good results are obtained, in particular, with dispersions in which the particle size is 1 to 10μ and especially 1 to 5μ. The particle size per se has no influence on the flameproofing effects which can be achieved but does have an influence on the stability of the dispersions.

The bromine-containing compounds usually have only poor wettability, so that, advantageously, they are suspended in water not just immediately prior to use but at an even earlier time. However, pure suspensions are relatively unstable and the bromine-containing compound rapidly settles out. A dispersing agent is therefore advantageously added to the aqueous formulation since this agent prevents rapid sedimentation of the bromine-containing compound. This sedimentation can be virtually completely prevented by the further appropriate addition of a protective colloid. The protective colloid can be incorporated into the dispersion before or after grinding.

Stable dispersions of this type can, if necessary, be converted into solid commercial forms by drying in a manner which is known per se, for example in an atomising drier or in a conventional paddle drier, and these forms can be redispersed at any time.

Grinding of the solid bromine-containing compounds can be effected in conventional equipment suitable for such purposes, for example in a glass ball mill or a sand mill or in a corundum disc mill.

In addition to the preferred aqueous embodiment, the flameproofing agents employed in the process according to the invention can also be in the form of organic solutions. Such solutions can be used, in particular, for liquid bromine-containing compounds, which are less preferred, and as a rule contain neither dispersing agents nor emulsifiers nor protective colloids.

Solvents which can be used are, inter alia, aliphatic esters and, in particular, aliphatic alcohols, ketones or amides having at most 4 carbon atoms, for example methanol, ethanol, acetone and methyl ethyl ketone, and also aromatic or cycloaliphatic hydrocarbons, for example benzene or cyclohexane, and in particular cycloaliphatic ketones, for example cyclohexanone or, especially, halogenated, and preferably chlorinated, aliphatic hydrocarbons having 1 to 7 carbon atoms, for example trichloroethylene, or mixtures of solvents, for example ethanol:methyl ethyl ketone in a ratio of 1:1.

In addition, dimethylformamide, as a specific representative of an amide, is a particularly important solvent by virture of its advantageous solvent power for bromine-containing compounds.

As a rule, the organic solutions contain 100 and 500 g, preferably 125 to 300 g and especially 150 to 250 g of the bromine compound per kg of solution.

The stabiliser employed in the process according to the invention can contain, in addition to the organo-tin compound, at least one solvent or water and, if desired, an emulsifier or dispersing agent and/or a protective colloid.

Solvents which can be used are the customary solvents commonly used for the preparation of plastics, such as organic phosphites, bisphenols, aromatic or aliphatic esters, glycols, glycol ethers, polyglycols or polyglycerols. Higher-boiling solvents, especially those having a boiling point of at least 150° C., which do not contain any reactive groups which are able to react with the organo-tin compounds are preferred. Trialkyl phosphites, triaryl phosphites or alkylaryl phosphites having 16 to 90 carbon atoms are particularly preferred.

Possible emulsifiers or dispersing agents which can be contained in the stabiliser are, in principle, also the above-mentioned dispersing agents or emulsifiers which are preferably contained in the flameproofing agent. Thus, in particular, condensation products of aromatic sulphonic acids and formaldehyde can be used. However, for use in the stabiliser, ethylene oxide adducts of fatty acids, fatty amines, fatty alcohols or alkylphenols, and especially epoxidised esters of fatty acids having 9 to 25 carbon atoms, for example lauric acid, palmitic acid, stearic acid, oleic acid, linoleic acid and linolenic acid, are preferred.

Organo-tin compounds which are in the solid state can be ground with a dispersing agent as mentioned above for the solid bromine-containing compounds and, if desired, processed in the presence of a protective colloid to give stable suspensions or dispersions.

Depending on the nature of the dispersing agent or emulsifier and/or protective colloid which may be employed, the stabilisers employed in the process according to the invention contain 50 to 80 percent by weight of the organo-tin compound.

However, as a preferred embodiment of the process according to the invention, stabilisers are employed on their own, i.e. without the additional use of a solvent and/or of an emulsifier.

The single-stage process, in which an aqueous formulation which contains both the flameproofing agent and the stabiliser is applied to the fibre material, is of primary interest. In this preferred embodiment, which, by viture of the single heat treatment, brings advantages, in particular of an economic nature, solid bromine compounds and dispersing agents are appropriately employed in the form of a fine dispersion.

The preferred organo-tin compounds of the formulae (42) to (46) can, for example, be processed with the preferred dispersing agents and the preferred bromine compounds, for example HBCD, to a stable aqueous dispersion which can be employed in the preferred single-stage process.

In the process according to the invention, it is most advantageous to employ 5 to 20 percent by weight of the organo-tin compound, relative to the amount of the bromine-containing compound.

The flameproofing agent and the stabiliser are now applied to the fibre materials to be treated. In the preferred single-stage process, a single application of the flameproofing agent together with the stabilizer is made.

In this case, the flameproofing agent is appropriately so diluted with water to give a liquor that, taking into account the liquor pick-up by the material to be treated, the applied amount of bromine after the heat treatment is, relative to the treated material, 0.5 to 10, and preferably 1 to 8, percent by weight, depending on the nature of the material and its weight per unit area.

In the process according to the invention, the flameproofing agent and the stabiliser, preferably in the form of an aqueous liquor, are applied to the organic, synthetic fibre materials by conventional methods, for example by spraying or printing and preferably by the exhaustion process or especially by padding.

In the case of the exhaustion process in particular, buffer substances, for example sodium carbonate, disodium phosphate and trisodium phosphate, triethanolamine, and preferably sodium acetate and in particular ammonium acetate, can appropriately be added to the flameproofing agent in order to protect the fibre materials to be provided with a flame-resistant finish.

After the formulations have been applied to the organic synthetic fibre materials, these materials are dried and, if appropriate, subsequently subjected to a heat treatment at elevated temperature. A suitable method comprises drying the treated material at temperatures of up to 120° C., for example 70° to 120° C., and subjecting it to a heat treatment above 120° C., for example at up to 220° C., preferably 130° to 220° C. or especially 150° to 220° C., i.e. subjecting it to a thermosol treatment.

The thermosol process is preferably carried out at 175° to 220° C. and as a rule takes 10 to 200 seconds and preferably 20 to 100 seconds. Particularly good results are obtained with 10 to 60 seconds.

In the case of the exhaustion process, which is less preferred, the heat treatment is appropriately carried out at 100° to 150° C.

After the heat treatment, a re-wash with an acid-binding agent, for example sodium carbonate or sodium bicarbonate, can be advantageous.

The organic synthetic fibre materials which, in particular, are rendered flame-resistant according to the invention contain, for example, polyamide fibres and especially polyester fibres. Fibres made of acrylonitrile copolymers can also be used. The fibre materials can be in any desired stage of processing, i.e. they can be provided with a flame-resistant finish when in the form of staple fibres, continuous filaments, woven fabrics or knitted fabrics, when dyed or non-dyed, when treated with optical bighteners or without such treatment or when in the form of textiles which have already been further processed. However, the material is preferably textile fibre material.

Examples of preferred polyamide fibres which can be used are those made of poly-2-caprolactam, polyhexylmethylenediamine adipate or poly-ω-amino-undecanoic acid.

However, polyester fibres are of primary interest.

These fibres are preferably those which are derived from terephthalic acid, for example poly-(ethylene glycol terephthalate) or poly-(1,4-cyclohexylenedimethylene terephthalate).

According to the invention, permanent flameproofing effects are obtained on the fibre materials and these effects are retained even after several washes or dry-cleaning operations. The finishes also have the advantage that the handle of the finished fibre materials is not felt to be oily, as is frequently the case with known agents. Moreover, the tendency of the fabric to dry soiling and wet soiling is greatly reduced. There is hardly any influence on the fastness to light and fastness to rubbing of dyeings.

A further advantage of the process according to the invention depends on the fact that better flameproofing effects are achieved than in the case of known processes, even when smaller amounts are applied.

Moreover, the textile-mechanical properties of the treated fibre materials are not adversely affected by the present flameproof finish. By virture of the small amount applied, there is virtually no impairment of, in particular, the good handle characteristics of the treated fabric. The same applies for the low flexural rigidity and the high tear strength of the finished fibre materials. Even printed fabrics can be treated according to the invention without this resulting in the quality of the print being impaired in any way.

The present flameproofing agents and stabilisers can also be employed simultaneously with dyestuffs or optical brighteners, so that it is possible to dye or brighten and render flame-resistant in a single process, if the process is carried out in a single stage.

Good results are also achieved when small amounts of a dispersing agent are employed, for example 0.1 to 3 percent by weight, relative to the liquor, so that re-washing can be dispensed with in some cases.

The particular advantage of the process according to the invention depends on the fact that synthetic fibre materials provided with a flame-resistant finish are obtained which, at the same time, are stabilised to light and heat. This stabilising effect is permanent, i.e. is retained even after the treated fibre material has been subjected to multiple washes in actual use. The finished fibre materials do not yellow to a substantial degree even when subjected to the action of heat and light for a prolonged period.

In the preparation instructions and examples which follow, percentages and parts are percentages by weight and parts by weight.

Preparation instructions for dispersions of flameproofing agents

A. 220 parts of HBCD are dispersed in a solution of 8 parts of a condensation product of a naphthalenesulphonic acid and formaldhyde in 172 parts of water and ground in a glass ball mill to an average particle size of 10μ. After grinding is complete, 40 parts of a 5% strength aqueous solution of carboxymethylcellulose (degree of etherification: 0.85; viscosity of a 1% strength solution: 10–20 cP) are mixed into the formulation. This gives a dispersion which flows readily and is stable on storage and in which, on settling, a sediment forms which can be stirred up easily.

B. The procedure is as indicated in Instructions A, but 220 parts of bis-2,3-dibromopropyl terephthalate are employed in place of 220 parts of HBCD.

A dispersion which flows readily and is stable on storage is obtained.

C. 200 parts of HBCD are dispersed with 500 parts of a 40% strength aqueous solution of a sulphonated condensation product of naphthalene and a mixture of chloromethyl-diphenyl isomers in 100 parts of water and ground in a glass ball mill to an average particle size of 1.2μ.

A dispersion which flows readily and is stable on storage is obtained.

Preparation instructions for emulsions or dispersions of stabilisers

D. 50 parts of the organo-tin compound of the formula (43) and 17 parts of an 89% strength aqueous mixture of an oleic acid polyglycol ester and of an ethoxylated octylphenol are emulsified together with 33 parts of water.

E. The procedure is as indicated in Instructions D, but 50 parts of the organo-tin compound of the formula (42) are employed.

F. 50 parts of the organo-tin compound of the formula (45) are dispersed in a solution of 2 parts of a condensation product of a naphthalenesulphonic acid and formaldehyde in 40 parts of water and ground in a glass ball mill to an average particle size of 10μ. After grinding is complete, 20 parts of a 5% strength aqueous solution of carboxymethylcellulose (degree of etherification: 0.85; viscosity of a 1% strength solution: 10–20 cP) are mixed into the formulation. This gives a dispersion which flows readily and is stable on storage and in which, on settling, a sediment forms which can be stirred up easily.

G. The procedure is as indicated in Instructions D, but 50 parts of the organo-tin compound of the formula (46) are employed. A flowable dispersion which is stable on storage is again obtained.

Preparation instructions for dispersions of flameproofing agents and stabilisers H. 200 parts of HBCD are dispersed with 400 parts of a 40% strength aqueous solution of a sulphonated condensation product of naphthalene and a mixture of chloromethyl-diphenyl isomers and with 20 parts of the organo-tin compound of the formula (44) in 180 parts of water and ground in a glass ball mill to an average particle size of 1.2μ.

A dispersion which flows readily and is stable on storage is obtained.

I. The procedure is as indicated in Instructions H, but 120 parts of the lignin-sulphonate obtained from acid digestion of wood and 260 parts of water are employed in place of 380 parts of the 40% strength aqueous solution of the sulphonated condensation product and 180 parts of water.

A dispersion which flows readily and is stable on storage is obtained.

J. The procedure is as indicated in Instructions I, but 20 parts of the organo-tin compound of the formula (45) are employed in place of 20 parts of the organo-tin compound of the formula (44).

A dispersion which flows readily and is stable on storage is obtained.

EXAMPLE 1

Polyester fabrics having a weight per unit area of 90 g/m$^2$ are padded with the aqueous liquors having the composition indicated in Table I which follows, dried for 30 minutes at 80° C. and then subjected to a thermosol treatment at 200° C. for 20 seconds. The liquor pick-up is 40%.

The fabric is then subjected to a re-wash for 5 minutes at 60° C. in a liquor which contains, per liter, 4 g of anhydrous sodium carbonate and 1 g of a condensation product of 1 mol of p-nonylphenol and 9 mols of ethylene oxide. The fabric is then rinsed and dried.

The fabric is then washed up to 25 times for 45 minutes each time at 60° C. in a household washing machine in a liquor which contains 4 g/l of a household detergent (SNV 198,861—washing).

In the vertical test according to DIN 53,906, the treated fabrics are flame-resistant both before and after the re-wash and after multiple washes, in actual use, i.e. the fabrics have after-burning times of 0 seconds and burning lengths of at most 12 cm. This is the case even after 25 washes, in actual use. Untreated fabric, on the other hand, burns away completely.

The whiteness of the fabrics (c.f. R. Griesser in "Tenside Detergents", 12[2], 93–100 (1975)) after exposure for 30 hours in the FDA-RC type Fadeometer (Manufacture: Atlas Electric Devices Company, Chicago, U.S.A., carbon arc UV lamp having maximum emission between 3,600 and 4,200 Å) was determined after the re-wash and after the washes in actual use.

The higher the value on the whiteness scale, the better is the whiteness. The values obtained are listed in Table I which follows:

Table I

| Composition of the liquor: | Designation of the liquor 1 | 2 | 3 | 4 |
|---|---|---|---|---|
| Amount of flameproofing agent dispersion according to Preparation Instructions A in g/kg of liquor | 250 | 250 | 250 | 250 |
| Amount of stabiliser emulsion according to Preparation Instructions D in g/kg of liquor | 0 | 12.5 | 25 | 50 |
| Content of HBCD in the flameproofing agent, % | 50 | 50 | 50 | 50 |
| Content of the organo-tin compound in the stabiliser, % | 50 | 50 | 50 | 50 |
| Whiteness of the treated fabrics after the re-wash | −211 | −77 | 7 | 105 |
| after 25 machine washes | — | −60 | 20 | 117 |

EXAMPLE 2

Polyester fabrics having a weight per unit area of 90 g/m$^2$ are padded with a liquor which contains, per kg of liquor, 250 g of the flameproofing agent dispersion according to Preparation Instructions A (50% of HBCD in dispersion) and are dried and subjected to a thermosol treatment and a re-wash, as indicated in Example 1. The treated fabric is flame-resistant according to DIN 53,906 before and after the re-wash, whilst untreated fabric burns away completely.

Using a liquor ratio of 1:20, the fabric provided with a flame-resistant finish in this way is treated by the exhaustion process in a dyeing apparatus with the aqueous liquors having the composition indicated in Table II, which follows, for 1 hour at 130° C.

The fabric after-treated in this way is also flame-resistant according to DIN 53,906.

After the exhaustion process, the whiteness of the fabrics is determined after exposure for 30 hours in a Fadeometer. The results are summarised in Table II which follows:

Table II

| Composition of the liquor: | Designation of the liquor 1 | 2 | 3 | 4 |
|---|---|---|---|---|
| Amount of stabiliser emulsion according to Preparation Instructions Din g/kg of liquor | 0 | 10 | 20 | 50 |
| Content of the organo-tin compound in the stabiliser, % | — | 50 | 50 | 50 |
| Whiteness of the treated fabrics after the exhaustion process | −24 | 94 | 77 | 70 |

EXAMPLE 3

A polyester staple fabric which has been set and bleached and has a weight per unit area of 140 g/m$^2$ is padded with an aqueous liquor which contains, per liter, 35 g of an optical brightener of the formula

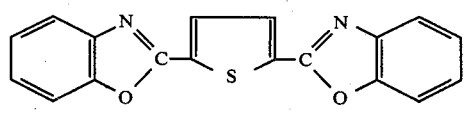

(51)

the liquor pick-up being 80%. After the padded fabric has been dried, it is subjected to a thermosol treatment for 20 seconds at 200° C.

The fabric brightened in this way is padded, with a liquor pick-up of 80%, with a liquor which contains, per kg of liquor, 250 g of the flameproofing agent dispersion according to Preparation Instructions A (50% of HBCD in dispersion) and is dried and subjected to a thermosol treatment and a re-wash, as indicated in Example 1. The fabric treated in this way is flame-resistant according to DIN 53,906, both before and after the re-wash; on the other hand, untreated fabric or fabric which has only been brightened burns away completely.

The fabric which has been brightened and provided with a flame-resistant finish is padded, with a liquor pick-up of 80%, with the aqueous liquors having the composition indicated in Table III which follows and is again dried and subjected to a thermosol treatment and a re-wash, as indicated in Example 1.

After this treatment with the stabiliser, the fabric still remains flame-resistant according to DIN 53,906, even after the re-wash.

Before and after the re-wash and also after the treatment with the stabiliser and also after the treatment with the flameproofing agent, the whiteness of the fabrics is determined after exposure in the Fadeometer for 30 and 60 hours, and the tear strength is measured according to SNV 198,461 after exposure in the Fadeometer for 30 hours. The results are summarised in Table III which follows.

Table III

| | Fabric treated with a flameproofing agent and a stabiliser | | | | | | | | partially treated fabric (no stabiliser) |
|---|---|---|---|---|---|---|---|---|---|
| | Designation of the liquor | | | | | | | | |
| | 1 | 2 | 3 | 4 | 5 | 6 | 7 | 8 | |
| Composition of the liquor: | | | | | | | | | |
| Amount of stabiliser emulsion according to Preparation Instructions D in g/kg of liquor | 12.5 | 50.0 | — | — | — | — | — | — | — |
| Amount of stabiliser emulsion according to Preparation Instructions E in g/kg of liquor | — | — | 12.5 | 50.0 | — | — | — | — | — |
| Amount of stabiliser dispersion according to Preparation Instructions F in g/kg of liquor | — | — | — | — | 13.9 | 55.6 | — | — | — |
| Amount of stabiliser dispersion according to Preparation Instructions G in g/kg of liquor | — | — | — | — | — | — | 13.9 | 55.6 | — |
| Content of the organo-tin compound in the stabiliser | 50 | 50 | 50 | 50 | 45 | 45 | 45 | 45 | — |
| Whiteness: | | | | | | | | | |
| after exposure in the Fadeometer for 30 hours | | | | | | | | | |
| before the re-wash | 86 | 104 | 23 | 60 | 77 | 89 | −5 | −11 | −100 |
| after the re-wash | 81 | 116 | 26 | 82 | 92 | 123 | 22 | 34 | −71 |
| after exposure in the Fadeometer for 60 hours | | | | | | | | | |
| before the re-wash | −49 | 44 | −103 | −70 | −65 | −9 | −125 | −136 | −164 |
| after the re-wash | −42 | 64 | −101 | −152 | −45 | 24 | −99 | −93 | −153 |
| Tear strength: | | | | | | | | | |
| after exposure in the Fadeometer for 30 hours | | | | | | | | | |
| before the re-wash, % | 74 | 79 | 68 | 69 | 80 | 84 | 69 | 65 | 58 |
| after the re-wash, % | 96 | 90 | 63 | 66 | 82 | 98 | 91 | 71 | 67 |

EXAMPLE 4

The polyester staple fabric is brightened as indicated in Example 3.

The fabric brightened in this way is padded, with a liquor pick-up of 80%, with a liquor which contains, per kg of liquor, 250 g of the flameproofing agent dispersion according to Preparation Instructions A (50% of HBCD in dispersion) and dried for 30 minutes at 80° C. At 200° C., a portion of the fabric is subjected to a thermosol treatment for 20 seconds and a portion of the fabric is subjected to a thermosol treatment for 60 seconds. The re-wash and 1, 10 and 25 machine washes are carried out as indicated in Example 1. All of the fabrics are flame-resistant according to DIN 53,906 both before and after the re-wash and the machine washes, whilst untreated fabric or fabric which has only been brightened burns away completely.

The whiteness after exposure in the Fadeometer for 30 and 60 hours was determined before and after the re-wash and after 1, 10 and 25 machine washes and the results are summarised in Table IV which follows.

The fabric which has been brightened and provided with a flame-resistant finish is now padded with a liquor which contains, per kg, 50 g of the stabiliser emulsion according to Preparation Instructions D (50% of the organo-tin compound of the formula (43) in emulsion) and dried for 30 minutes at 80° C. Those fabrics which have been subjected to a thermosol treatment for 20 seconds after the treatment with the HBCD dispersion are now also subjected to a thermosol treatment for 20 seconds at 200° C. after the after-treatment, and the fabrics which were subjected to a thermosol treatment for 60 seconds after the treatment with HBCD are now also subjected to a thermosol treatment for 60 seconds at 200° C. after the after-treatment. The re-wash and 1, 10 and 25 machine washes are carried out as indicated in Example 1. All of the fabrics remain flame-resistant according to DIN 53,906 even after the treatment with the stabiliser and even after the re-wash and after 25 machine washes.

The whiteness after exposure in the Fadeometer for 30 and 60 hours is again determined and the results are also summarised in Table IV which follows.

Table IV

| Thermosol treatment time, seconds | Fabric treated with the flameproofing agent and the stabiliser | | Fabric treated only with the flameproofing agent | |
|---|---|---|---|---|
| | 20 | 60 | 20 | 60 |
| Whiteness | | | | |
| after exposure in the Fadeometer for 30 hours | | | | |
| before the re-wash | 76 | 105 | −124 | −63 |
| after the re-wash | 93 | 112 | −95 | −52 |
| after 1 machine wash | 100 | 116 | −71 | −54 |
| after 10 machine washes | 93 | 122 | −65 | −60 |
| after 25 machine washes | 91 | 129 | −56 | −48 |
| after exposure in the Fadeometer for 60 hours | | | | |
| before the re-wash | −102 | −21 | −178 | −144 |
| after the re-wash | 68 | 46 | −145 | −21 |
| after 1 machine wash | −31 | 80 | −163 | −145 |
| after 10 machine washes | −54 | 98 | −140 | −36 |
| after 25 machine washes | 41 | 52 | −170 | −151 |

EXAMPLE 5

A staple fabric made of polyester and having a weight per unit area of 130 g/m$^2$ was padded with a solution in cyclohexanone which contains the flameproofing agents and stabilisers indicated in Table V which follows, the liquor pick-up being 80%. The padded fabric was dried at 80° C. and then subjected to a thermosol treatment for 20 seconds at 200° C. The treated fabrics are flame-resistant according to DIN 53,906, while untreated fabric burns away completely.

The results obtained from determination of the whiteness after exposure in the Fadeometer for 60 and 120 hours are summarised in Tables V to VIII which follow.

In place of HBCD and the organo-tin compounds of the formulae (42) to (46), it is possible to employ the bromine compounds indicated on page 4, line 10 to line 25, and the organo-tin compounds of the formulae (9) to (41), similar results being obtained.

Table V

| | Designation of the liquor | | | | | | | | | |
|---|---|---|---|---|---|---|---|---|---|---|
| Composition of the liquor | 1 | 2 | 3 | 4 | 5 | 6 | 7 | 8 | 9 | 10 |
| HBCD, g/l | 125 | 125 | 125 | 125 | 125 | 188 | 188 | 188 | 188 | 188 |
| Organo-tin compound of the formula (42), in g/l | 6.2 | — | — | — | — | 9.4 | — | — | — | — |
| Organo-tin compound of the formula (43), in g/l | — | 6.2 | — | — | — | — | 9.4 | — | — | — |
| Organo-tin compound of the formula (45) | — | — | 6.2 | — | — | — | — | 9.4 | — | — |
| Organo-tin compound of the formula (46), g/l | — | — | — | 6.2 | — | — | — | — | 9.4 | — |
| Whiteness after exposure in the Fadeometer for 60 hours | 27 | 20 | 41 | −6 | −74 | 21 | 8 | 17 | 22 | −159 |

Table VI

| | Designation of the liquor | | | | | | | | | |
|---|---|---|---|---|---|---|---|---|---|---|
| | 11 | 12 | 13 | 14 | 5 | 15 | 16 | 17 | 18 | 10 |
| Composition of the liquor | | | | | | | | | | |
| HBCD, g/l | 125 | 125 | 125 | 125 | 125 | 188 | 188 | 188 | 188 | 188 |
| Organo-tin compound of the formula (42), g/l | 12.5 | — | — | — | — | 18.8 | — | — | — | — |
| Organo-tin compound of the formula (43), g/l | — | 12.5 | — | — | — | — | 18.8 | — | — | — |
| Organo-tin compound of the formula (45), g/l | — | — | 12.5 | — | — | — | — | 18.8 | — | — |
| Organo-tin compound of the formula (46), g/l | — | — | — | 12.5 | — | — | — | — | 18.8 | — |
| Whiteness after exposure in the Fadeometer for 60 hours | 29 | 39 | 38 | 31 | −74 | 35 | −6 | −15 | −103 | −159 |

Table VII

| | Designation of the liquor | | | | | | | | | |
|---|---|---|---|---|---|---|---|---|---|---|
| | 19 | 20 | 21 | 22 | 23 | 24 | 25 | 26 | 27 | 28 |
| Composition of the liquor | | | | | | | | | | |
| HBCD, g/l | 62 | 62 | 62 | 62 | 62 | 62 | 62 | 62 | 62 | 62 |
| Organo-tin compound of the formula (42), g/l | 3.1 | — | — | — | — | 6.2 | — | — | — | — |
| Organo-tin compound of the formula (43), g/l | — | 3.1 | — | — | — | — | 6.2 | — | — | — |
| Organo-tin compound of the formula (45), g/l | — | — | 3.1 | — | — | — | — | 6.2 | — | — |
| Organo-tin compound of the formula (46), g/l | — | — | — | 3.1 | — | — | — | — | 6.2 | — |
| Whiteness after exposure in the Fadeometer for 120 hours | 39 | 40 | 43 | 39 | 18 | 44 | 41 | 46 | 46 | 18 |

Table VIII

| | Designation of the liquor | | | | | | | | |
|---|---|---|---|---|---|---|---|---|---|
| | 29 | 30 | 31 | 32 | 33 | 34 | 35 | 36 | 37 |
| Composition of the liquor: | | | | | | | | | |
| HBCD, g/l | 62 | 100 | 138 | 62 | 100 | 138 | 62 | 100 | 138 |
| Organo-tin compound of | | | | | | | | | |

Table VIII-continued

| | Designation of the liquor | | | | | | | | |
|---|---|---|---|---|---|---|---|---|---|
| | 29 | 30 | 31 | 32 | 33 | 34 | 35 | 36 | 37 |
| the formula (44), g/l | 3.1 | 5 | 6.9 | 6.2 | 10 | 13.8 | — | — | — |
| Whiteness | | | | | | | | | |
| after exposure in the Fadeometer for 60 hours | 43 | 40 | 35 | 43 | 39 | 35 | 33 | 21 | −76 |
| after exposure in the Fadeometer for 120 hours | 40 | 34 | −31 | 38 | 23 | 17 | 18 | −19 | −147 |

EXAMPLE 6

The procedure is as indicated in Example 5 but the treatment is carried out on a polyester staple fabric which has previously been brightened as indicated in Example 3.

The treated fabrics are flame-resistant according to DIN 53,906, whilst untreated fabric burns away completely.

The results obtained from determination of the whiteness after exposure in the Fadeometer for 60 and 120 hours are summarised in Tables IX to XII which follow.

Table IX

| | Designation of the liquor | | | | | | | | | |
|---|---|---|---|---|---|---|---|---|---|---|
| | 1 | 2 | 3 | 4 | 5 | 6 | 7 | 8 | 9 | 10 |
| Composition of the liquor: | | | | | | | | | | |
| HBCD, g/l | 125 | 125 | 125 | 125 | 125 | 188 | 188 | 188 | 188 | 188 |
| Organo-tin compound of the formula (42), g/l | 6.2 | — | — | — | — | 9.4 | — | — | — | — |
| Organo-tin compound of the formula (43), g/l | — | 6.2 | — | — | — | — | 9.4 | — | — | — |
| Organo-tin compound of the formula (45), g/l | — | — | 6.2 | — | — | — | — | 9.4 | — | — |
| Organo-tin compound of the formula (46), g/l | — | — | — | 6.2 | — | — | — | — | 9.4 | — |
| Whiteness | | | | | | | | | | |
| after exposure in the Fadeometer for 60 hours | 57 | −3 | 74 | 70 | −69 | 77 | −103 | 66 | 65 | −247 |

Table X

| | Designation of the liquor | | | | | | | | | |
|---|---|---|---|---|---|---|---|---|---|---|
| | 11 | 12 | 13 | 14 | 5 | 15 | 16 | 17 | 18 | 10 |
| Composition of the liquor | | | | | | | | | | |
| HBCD, g/l | 125 | 125 | 125 | 125 | 125 | 188 | 188 | 188 | 188 | 188 |
| Organo-tin compound of the formula (42), g/l | 12.5 | — | — | — | — | 18.8 | — | — | — | — |
| Organo-tin compound of the formula (43), g/l | — | 12.5 | — | — | — | — | 18.8 | — | — | — |
| Organo-tin compound of the formula (45), g/l | — | — | 12.5 | — | — | — | — | 18.8 | — | — |
| Organo-tin compound of the formula (46), g/l | — | — | — | 12.5 | — | — | — | — | 18.8 | — |
| Whiteness | | | | | | | | | | |
| after exposure in the Fadeometer for 60 hours | 72 | 119 | 127 | −56 | −69 | 20 | 5 | 100 | −101 | −247 |

Table XI

| | Designation of the liquor | | | | | | | | | |
|---|---|---|---|---|---|---|---|---|---|---|
| | 19 | 20 | 21 | 22 | 23 | 24 | 25 | 26 | 27 | 28 |
| Composition of the liquor: | | | | | | | | | | |
| HBCD, g/l | 62 | 62 | 62 | 62 | 62 | 62 | 62 | 62 | 62 | 62 |
| Organo-tin compound of the formula (42), g/l | 3.1 | — | — | — | — | 6.2 | — | — | — | — |
| Organo-tin compound of the formula (43), g/l | — | 3.1 | — | — | — | — | 6.2 | — | — | — |
| Organo-tin compound of the formula (45), g/l | — | — | 3.1 | — | — | — | — | 6.2 | — | — |
| Organo-tin compound of the formula (46), g/l | — | — | — | 3.1 | — | — | — | — | 6.2 | — |
| Whiteness | | | | | | | | | | |
| after exposure in the | | | | | | | | | | |

Table XI-continued

| | Designation of the liquor | | | | | | | | | |
|---|---|---|---|---|---|---|---|---|---|---|
| | 19 | 20 | 21 | 22 | 23 | 24 | 25 | 26 | 27 | 28 |
| Fadeometer for 120 hours | 145 | 135 | 144 | 151 | 115 | 135 | 125 | 149 | 134 | 115 |

Table XII

| | Designation of the liquor | | | | | | | | |
|---|---|---|---|---|---|---|---|---|---|
| | 29 | 30 | 31 | 32 | 33 | 34 | 35 | 36 | 37 |
| Composition of the liquor | | | | | | | | | |
| HBCD, g/l | 62 | 100 | 138 | 62 | 100 | 138 | 62 | 100 | 138 |
| Organo-tin compound of the formula (44), g/l | 3.1 | 5 | 6.9 | 6.2 | 10 | 13.8 | — | — | — |
| Whiteness | | | | | | | | | |
| after exposure in the Fadeometer for 60 hours | 170 | 152 | 103 | 167 | 152 | 118 | 153 | 95 | −101 |
| after exposure in the Fadeometer for 120 hours | 157 | 109 | 20 | 151 | 101 | 40 | 123 | 26 | −149 |

EXAMPLE 7

Polyester fabrics are padded with the aqueous liquors having the composition indicated in Table XIII which follows, dried for 30 minutes at 80° C. and subjected to a thermosol treatment at 200° C. for 30 seconds. The liquor pick-up is 100%.

The fabric is then subjected to a re-wash as indicated in Example 1.

In the vertical test according to DIN 53,906, the treated fabrics are flame-resistant both before and after the re-wash, i.e. the fabrics have after-burning times of 0 seconds and burning lengths of at most 12 cm. Untreated fabric, on the other hand, burns away completely.

The whiteness of the fabrics is measured, as indicated in Example 1, before and after the re-wash, without exposure in the Fadeometer and after exposure in the Fadeometer for 30 hours, and the results are also summarised in Table XIII which follows.

Table XIII

| | Designation of the liquor | | | | |
|---|---|---|---|---|---|
| | 1 | 2 | 3 | 4 | 5 |
| Composition of the liquor | | | | | |
| Amount of flameproofing agent dispersion according to Instructions B in g/kg of liquor | 200 | 400 | 200 | 200 | 400 |
| Amount of stabiliser emulsion according to Instructions D in g/kg of liquor | — | — | 20 | 40 | 40 |
| Content of bis-dibromopropyl terephthalate in the flameproofing agent, % | 50 | 50 | 50 | 50 | 50 |
| Content of the organo-tin compound of the formula (43) in the stabiliser, % | — | — | 50 | 50 | 50 |
| Whiteness of the treated fabrics | | | | | |
| without exposure in the Fadeometer | | | | | |
| before the re-wash | 33 | 13 | 133 | 150 | 122 |
| after the re-wash | 89 | 89 | 175 | 179 | 171 |
| after exposure in the Fadeometer for 60 hours | | | | | |
| before the re-wash | −65 | −190 | 24 | 46 | −31 |
| after the re-wash | 51 | 49 | 122 | 129 | 104 |

EXAMPLE 8

A polyester staple fabric is brightened as indicated in Example 3.

The fabric brightened in this way is padded, with a liquor pick-up of 65%, with the aqueous liquors having the composition indicated in Table XIV which follows, dried at 80° C. for 30 minutes and subjected to a thermosol treatment for 20 seconds at 200° C. The re-wash is carried out as indicated in Example 1.

The treated fabrics are flame-resistant according to DIN 53,906, both before and after the re-wash, whilst untreated fabric burns away completely.

After the re-wash, the whiteness of the fabrics is measured as indicated in Example 1 after exposure in the Fadeometer for 60 hours, and the results are also summarised in Table XIV which follows.

Similar results are obtained with the organo-tin compounds of the formulae (9) to (43) and (46) to (50) and with the bromine compounds according to page 4, line 10 to line 25.

Table XIV

| | Designation of the liquor | | | |
|---|---|---|---|---|
| | 1 | 2 | 3 | 4 |
| Composition of the liquor | | | | |
| Amount of the flameproofing agent dispersion according to Instructions C in g/kg of liquor | 616 | — | — | — |
| Amount of flameproofing agent and stabiliser dispersion according to Instructions H in g/kg of liquor | — | 616 | — | — |
| Amount of flameproofing agent and stabiliser according to Instructions I in g/kg of liquor | — | — | 465 | — |
| Amount of flameproofing agent and stabiliser according to Instructions J in g/kg of liquor | — | — | — | 465 |
| Content of HBCD in dispersion, % | 25 | 25 | 33 | 33 |
| Content of the organo-tin compound of the formula (44) in dispersion, % | 0 | 2.5 | 3.3 | 0 |
| Content of the organo-tin compound of the formula (45) in dispersion, % | 0 | 0 | 0 | 3.3 |
| Whiteness of the treated fabrics | | | | |
| after the re-wash and exposure in the Fadeometer for 60 hours | −40 | 5 | 5 | 50 |

EXAMPLE 9

A polyester fabric is brightened as indicated in Example 3.

The fabric brightened in this way is padded, with a liquor pick-up of 65%, with solutions in a mixture of ethyl acetate and dimethylformamide in a weight ratio of 66:34, these solutions containing the flameproofing agents and stabilisers indicated in Table XV which follows. The padded fabric was dried at 80° C. and then subjected to a thermosol treatment at 200° C. for 20 seconds. The fabric was then subjected to a re-wash as indicated in Example 1. The treated fabrics are flame-resistant according to DIN 53,906, both before and after the re-wash, whilst untreated fabric burns away completely.

The results obtained from determination of the whiteness after exposure in the Fadeometer for 60 hours, before and after the re-wash, are also summarised in Table XV which follows.

Table XV

| | Designation of the liquor | | | | |
|---|---|---|---|---|---|
| | 1 | 2 | 3 | 4 | 5 |
| Composition of the liquor | | | | | |
| HBCD, g/l | 154 | 154 | 154 | 154 | 154 |
| Organo-tin compound of the formula (26), g/l | — | 30.8 | — | — | — |
| Organo-tin compound of the formula (47), g/l | — | — | 30.8 | — | — |
| Organo-tin compound of the formula (48), g/l | — | — | — | 18.5 | — |
| Organo-tin compound of the formula (49), g/l | — | — | — | 12.3 | — |
| Organo-tin compound of the formula (50), g/l | — | — | — | — | 30.8 |
| Whiteness of the treated fabrics after exposure in the Fadeometer for 60 hours | | | | | |
| before the re-wash | −195 | 120 | 75 | 85 | 135 |
| after the re-wash | −115 | 140 | 100 | 105 | 135 |

What is claimed is:

1. A process for flameproofing organic synthetic fibre material, which comprises applying to said material (a) a flameproofing agent which contains a brominated cycloalkane having 7 to 12 ring carbon atoms and 4 to 6 bromine atoms bnded to these ring carbon atoms, and (b) a stabilizer which contains a monomeric or polymeric organo-tin compound of the formula

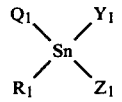

in which $R_1$ is an aliphatic, cycloaliphatic or aromatic hydrocarbon radical, $Y_1$ is an aliphatic hydrocarbon radical bonded via an —O— or —OOC— bridge, or is of the formula —S—$X_1$, in which $X_1$ is an aliphatic or aromatic hydrocarbon radical, and $Z_1$ and $Q_1$ in each case have the meanings defined for $R_1$ or $Y_1$, or $Y_1$ and $Z_1$ together are =S or =O or are a divalent organic radical which, together with the Sn atom, forms a heterocyclic ring, the ring having an —S—, —O— or —OOC— bridge in the position adjacent to the Sn atom, or, if the organo-tin compound is in the polymeric form, $Q_1$ is also hydroxyl and $Y_1$ and $Z_1$ together are an —S— or —O— bridge which is bonded to different Sn atoms, or, if $Y_1$ and $Z_1$ togther are =S, $Q_1$ is also —SH, and subjecting the fibre material treated in this way to a heat treatment.

2. A process according to claim 1, in which the flameproofing agent contains 1,2,5,6,9,10-hexabromocyclododecane.

3. A process according to claim 1, in which the stabiliser contains an organo-tin compound of the formula

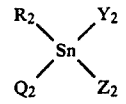

in which $R_2$ is alkyl having 1 to 18 carbon atoms or alkenyl having 2 to 18 carbon atoms, which are unsubstituted or substituted by a keto group or by an alkylcarboxylic acid alkyl ester group having 2 to 18 carbon atoms, or are phenyl, naphthyl or cycloalkyl or cycloalkenyl having 5 or 6 ring members, or benzyl, $Y_2$ is alkoxy having 1 to 18 carbon atoms, a carboxyl radical of a monocarboxylic acid having 1 to 18 carbon atoms or a carboxyl radical of a dicarboxylic acid monoalkyl ester having 2 to 8 carbon atoms in the acid part and 1 to 18 carbon atoms in the alcohol part, or the radical of a mercaptomonocarboxylic acid alkyl ester or mercaptodicarboxylic acid alkyl ester or monocarboxylic acid mercaptoalkyl ester, each having 2 to 8 carbon atoms in the alcohol part, or is of the formula —S—$X_2$, in which $X_2$ is alkyl having 1 to 18 carbon atoms which is unsubstituted or substituted by hydroxyl or alkoxy having 1 to 18 carbon atoms, or is phenyl, naphthyl or benzyl which are unsubstituted or substituted by halogen or alkyl having 1 to 4 carbon atoms, and $Z_2$ and $Q_2$ in each case have the meanings defined for $R_2$ or $Y_2$, or $Y_2$ and $Z_2$ together, as a divalent organic radical, with the Sn atom form a ring in which the divalent radical is derived from a dicarboxylic acid, a mercaptomonocarboxylic acid, a hydroxymonocarboxylic acid, a glycol di-mercaptocarboxylic acid ester, a dicarboxylic acid dimercaptoalkyl ester, a hydroxymonothiocarboxylic acid, a glycol or a monothioglycol or dithioglycol, each having 2 to 18 carbon atoms, and is bonded to the Sn atom via the two indicated free functional groups, or $Y_2$ and $Z_2$ together, in the case of monomeric organo-tin compounds, are also =S or =O, or, in the case of polymeric organo-tin compounds, are also —S— or —O— bridges, which are bonded to different Sn atoms, and, if the organo-tin compound is in a polymeric form dehydrated to different degrees, $Q_2$ is also hydroxyl, or, if $Y_2$ and $Z_2$ together are =S, $Q_2$ is also —SH.

4. A process according to claim 1, in which the stabiliser contains a monomeric organo-tin compound of the formula

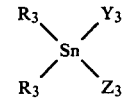

in which $R_3$ is alkyl having 1 to 18 carbon atoms, $Y_3$ and $Z_3$ in each case are a carboxyl radical of a dicarboxylic acid monoalkyl ester or the radical of a mercaptomonocarboxylic acid alkyl ester, each having 2 to 8 carbon atoms in the acid part and 1 to 18 carbon atoms in the alcohol part, or $Y_3$ and $Z_3$ together with the Sn atom form a ring and are the radical of a dicarboxylic acid or of a mercaptomonocarboxylic acid, each having 2 to 18 carbon atoms.

5. A process according to claim 1, in which the stabiliser contains an organo-tin compound of the formula

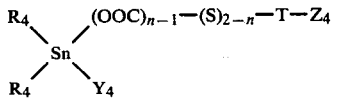

in which n is 1 or 2, $R_4$ is alkyl having 4 to 12 carbon atoms, T is methylene, ethylene or vinylidene, $Y_4$ is $—(OOC)_{n-1}—(S)_{2-n}—T—COOR_4$ and $Z_4$ is $—COOR_4$, or $Y_4$ and $Z_4$ together are —OOC—.

6. A process according to claim 1, in which the flame-proofing agent contains, in addition to the bromine-containing compound, at least one dispersing agent or emulsifier, water and, if desired, at least one protective colloid or at least one solvent.

7. A process according to claim 6, in which lignin-sulphonates, ethylene oxide adducts of alkylphenols, fatty amines, fatty alcohols or fatty acids; sulphonated condensation products of polynuclear halogenated aromatic compounds; aromatic sulphonic acids or their condensation products with formaldehyde; saturated aliphatic dicarboxylic acids substituted by relatively long-chain alkyl radicals; sulphonated substituted benzimidazoles or sulphonated fatty acid amides are employed as the dispersing agent or emulsifier.

8. A process according to claim 6, in which polyvinyl alcohol, hydroxyethylcellulose or carboxymethylcellulose is employed as the protective colloid.

9. A process according to claim 1, wherein the flame-proofing agent contains 50 to 700 g/kg of the bromine-containing compound, 0 to 700 g/kg of a dispersing agent and 0 to 30 g/kg of a protective colloid and water to make up to 1 kg.

10. A process according to claim 1, in which the stabiliser contains, in addition to the organo-tin compound, at least one solvent or water and, if desired, an emulsifier or dispersing agent and a protective colloid.

11. A process according to claim 1, in which 5 to 20 percent by weight of the organo-tin compound, relative to the amount of bromine-containing compound, are employed.

12. The fibre material rendered flame-resistant according to claim 1.

* * * * *